US009186007B2

(12) United States Patent
Srivatsan

(10) Patent No.: US 9,186,007 B2
(45) Date of Patent: Nov. 17, 2015

(54) MULTI-PERSON STRAW FOR SHARING/TASTING BEVERAGES

(75) Inventor: Akshay Srivatsan, San Antonio, CA (US)

(73) Assignee: Akshay Srivatsan, Palo Alto, CA (US)

( * ) Notice: Subject to any disclaimer, the term of this patent is extended or adjusted under 35 U.S.C. 154(b) by 1438 days.

(21) Appl. No.: 12/628,128

(22) Filed: Nov. 30, 2009

(65) Prior Publication Data

US 2011/0127349 A1 Jun. 2, 2011

(51) Int. Cl.
*A47G 21/18* (2006.01)

(52) U.S. Cl.
CPC ..... *A47G 21/185* (2013.01); *A47G 21/182* (2013.01)

(58) Field of Classification Search
CPC ..... A47G 21/185; A47G 21/182
USPC ..... 239/33
See application file for complete search history.

(56) References Cited

U.S. PATENT DOCUMENTS 1,494,742 A * 5/1924 Hills ..... 30/141
3,260,462 A * 7/1966 Smaczny ..... 239/33
5,160,087 A * 11/1992 Mandell ..... 239/33

FOREIGN PATENT DOCUMENTS

FR 2698773 A3 * 6/1994
KR 1020070115528 * 12/2007

* cited by examiner

*Primary Examiner* — Jason Boeckmann

(57) ABSTRACT

The design of a beverage sharing/tasting straw with one dipping end and plurality of independent suction ends, each differentiable from the other through a combination of one or more of color, size, unique sleeve, logo, material, design and the like to enable multiple people to share/taste the same beverage without risk of transmitting virus, bacteria or other germs, either for one-time consumption or during re-use. The length of the straw dimensions of the suction ends and distance between suction ends can be customized for a specific number of people, ages and seating configurations (e.g. sharing for 2 kids seated next to each other). In one particular embodiment of this design, the beverage sharing/tasting straw end attachment can be adapted to fit over any currently available standard straw thereby converting a traditional single person straw to a multi-person sharing/tasting straw.

1 Claim, 5 Drawing Sheets

MULTI-PERSON STRAW FOR SHARING/TASTING BEVERAGES

BACKGROUND

The present invention relates generally to drinking straws used typically to drink beverages from bottles, cans, cups and the like, and more particularly to a design and apparatus that allows multiple people to share and/or taste the same beverage without the risk of transmitting virus, bacteria or other germs through use of the same straw by several people.

Although there have been a number of inventions related to regulating flow rate through a straw, most straws are designed for use by a single person. Sharing the same straw across multiple people is unhygienic, since the suction end is in contact with the mouth/saliva of the person consuming the beverage and has high risk of transmitting germs (including those that cause common cold, flu, H1N1 and other infectious diseases) from one user to another. Design of current beverage cup lids does not allow multiple straws to be inserted into the same cup forcing single person consumption from each beverage cup. Moreover, since straws available in restaurants tend to be of same color, size and material, they are indistinguishable from one another, this also leads to the same problem of transmitting germs if multiple people use the same straw as they share. Even if multiple straws are used, each person has to either withdraw his/her straw or keep track of it between multiple sips. Due to the limited storage/holding space available for beverage containers in automobiles, it will be great for families to share the drink from the same beverage container without transmitting germs. Given the current economy, a multi-person beverage sharing/tasting straw provides a more economical and fun-way for families to share the pleasure of drinking beverages. Particularly in emerging markets and countries where a single cup of beverage could equal several days' pay for some people and thus sharing a cup enables multiple people to taste/enjoy the beverage without fear of infection. In addition, readily available straws are indistinguishable from each other and discarded after one use. Given the potential for families to use their own multi-person straws within the same set of individuals, a multi-person straw also has the potential to be recycled within families, thus reducing the total consumption of plastic straws and to a smaller extent, due to sharing, fewer beverage cups thus promoting a "greener" way to consume beverages.

As such, what is needed is a design and apparatus that allows multiple people to share/taste a beverage from the same beverage cup/container, by providing multiple suction ends while allowing each suction-end to be differentiable, so multiple people can share/taste the beverage, each distinguishing and using their own suction end, either one-time or in a re-use mode, thus minimizing risk of spreading germs.

SUMMARY

The design of a beverage sharing/tasting straw with one dipping end and a plurality of suction ends, each suction end distinguishable from others through different colors or use of tags, sleeves or other identification forms to enable multiple people to share/taste the same beverage, either one-time or in a re-use mode, without risk of transmitting viruses/bacteria or other germs from one person to another through oral contact with the straw. The length of the straw, dimensions of the suction ends and distance between suction ends can be customized for a specific number of people (e.g. family members in a family) or a mix of different ages (e.g. kids only or adults only or a mixture of kids and adults) or sizes (e.g. typical facial dimensions for 2 people seated side-by-side or across the table). In one particular embodiment of this design, the beverage sharing/tasting straw end assembly can be adapted to fit over any currently available standard straw thereby converting a traditional single person straw to a multi-person sharing/tasting straw.

The construction and method of operation of the invention, however, together with additional objectives and advantages thereof will be best understood from the following description of specific embodiments when read in connection with the accompanying drawings.

DESCRIPTION

The invention claimed here enables multiple people to share/taste same beverage without risk of transmitting virus, bacteria or other germs. The beverage sharing/tasting straw described here comprises of one dipping end and a plurality of independent suction ends, each uniquely differentiable through one or more of color, sleeve, logo, material or design. The length of the straw, dimensions of the suction ends and distance between suction ends can be customized for a specific number of people or a mix of different ages (e.g. kids only or adults only or a mixture of kids and adults) and dimensions (e.g. 2 people sitting side by side or across the table). In one particular embodiment of this design, the beverage sharing/tasting straw end assembly can be adapted to fit over any currently available standard straw thereby converting a traditional single person straw to a multi-person sharing/tasting straw for use one-time or in a reusable mode.

Figure 1A:
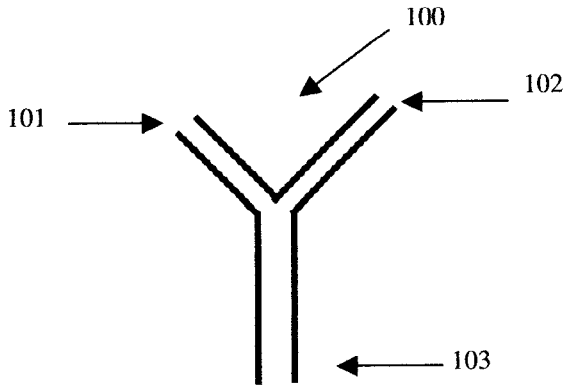
FIG. 1*a*-1*c* illustrate a beverage sharing/tasting straw with two, three, four suction ends respectively in accordance with an embodiment of the present invention.

FIG. 1*a* illustrates a beverage sharing/tasting straw 100 with two independent suction ends in accordance with an embodiment of the present invention. The dipping end 103 is placed inside the beverage cup/container. The two independent suction heads 101 and 102 enable two different people to drink from the same beverage cup/container without risk of transmitting viruses. This would be ideal for couples or families with 2 children that want to share a beverage from the same cup or container.

Figure 1B:
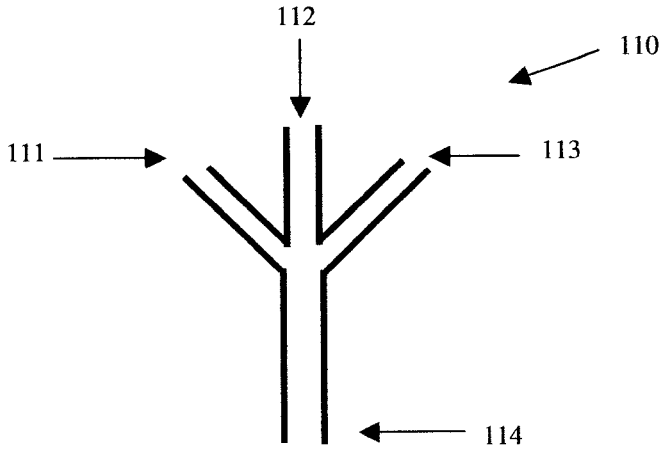

FIG. 1*b* illustrates a beverage sharing/tasting straw 110 with three independent suction ends in accordance with an embodiment of the present invention. The dipping end 114 is placed inside the beverage cup/container. The three independent suction heads 111, 112 and 113 enable three different people to drink from the same beverage cup/container without risk of transmitting viruses. This would be ideal for 3 person families or families with 3 kids that want to share a beverage from the same cup or container.

Figure 1C:
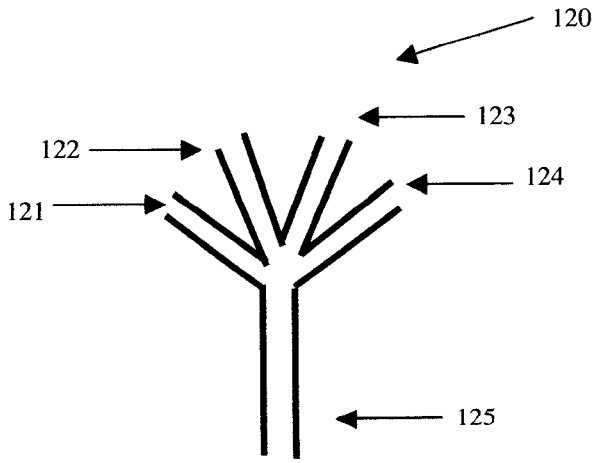

FIG. 1*c* illustrates a beverage sharing/tasting straw 120 with four independent suction ends in accordance with an embodiment of the present invention. The dipping end 125 is placed inside the beverage cup/container. The four independent suction heads 121, 122, 123 and 124 enable four different people to drink from the same beverage cup/container without risk of transmitting viruses. This would be ideal for families who want to share the beverage. Each suction head could be made distinguishable for each child, for example to make this re-usable.

Figure 2A:
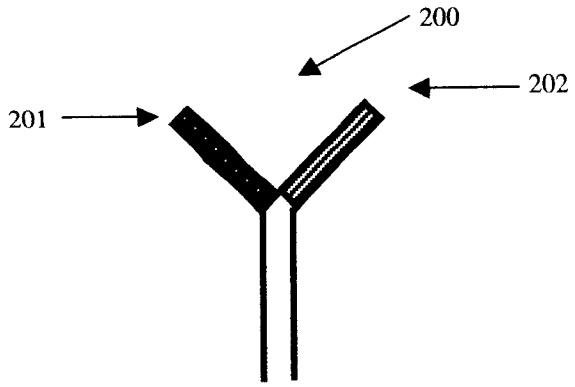
FIG. 2*a*-2*c* illustrate a beverage sharing/tasting straw where each suction end is uniquely distinguishable from others through use of colors, sleeves or unique characters/logos on each suction end in accordance with another embodiment of the present invention.

FIG. 2*a* illustrates a beverage sharing/tasting straw 200 where each suction end is made to be uniquely distinguishable from others through use of different colors on suction end in accordance with another embodiment of the present invention. The two suction ends 201 and 202 are made of different colors to distinguish them so each person can choose a particular color suction end and drink from the same beverage cup/container without risk of transmitting viruses.

Figure 2B:
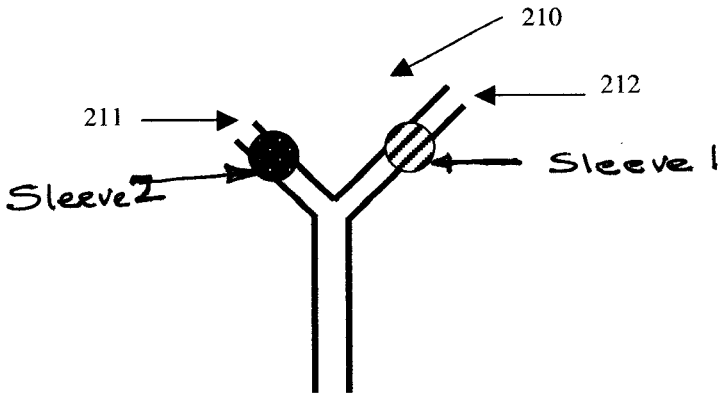

FIG. 2*b* illustrates a beverage sharing/tasting straw 210 where each suction end is made to be uniquely distinguishable from others through use of different sleeves on suction end in accordance with another embodiment of the present invention. The two suction ends 211 and 212 have two different sleeves to distinguish them so each person can choose a suction end with a unique sleeve and drink from the same beverage cup/container without risk of transmitting viruses.

Figure 2C:
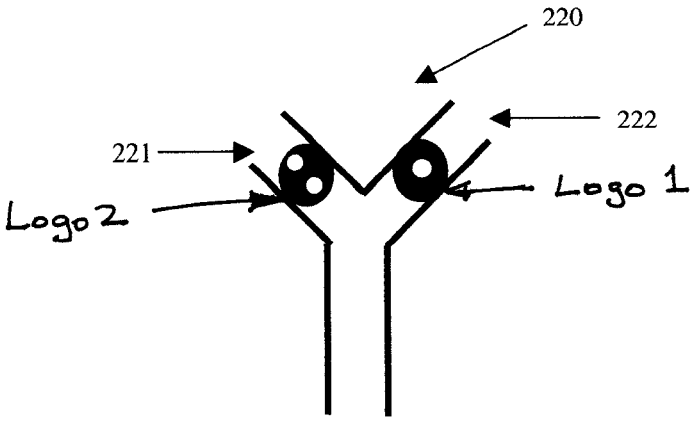

FIG. 2*c* illustrates a beverage sharing/tasting straw 220 where each suction end is made to be uniquely distinguishable from others through use of different characters on suction end in accordance with another embodiment of the present invention. The two suction ends 221 and 222 are made of different characters to distinguish them so each person can choose a particular character suction end and drink from the same beverage cup/container without risk of transmitting viruses.

Figure 3:
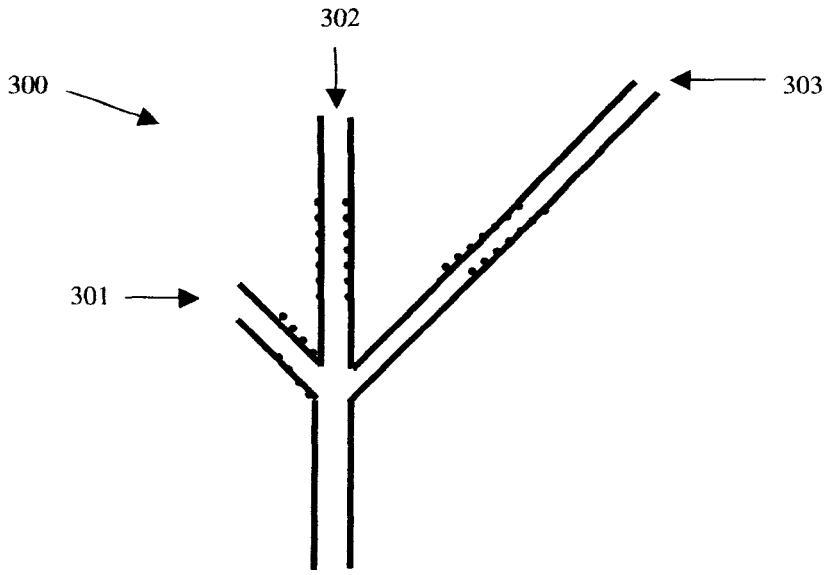
FIG. 3 illustrates the use of a beverage sharing/tasting straw where the length of each suction end and distance between suction ends is customized in accordance with yet another embodiment of the present invention.

FIG. 3 illustrates the use of a beverage sharing/tasting straw 300 where the length of each suction end and distance between suction ends is customized in accordance with another embodiment of the present invention. The beverage sharing/tasting straw 300 consists of three suction ends 301, 302 and 303. The length of suction end 301 is small, length of suction end 302 is medium, and length of suction end 303 is large to adapt to kids/adults and to distinguish them so each person can choose a particular character suction end and drink from the same beverage cup/container without risk of transmitting viruses. More advanced versions could include customizing for standard seating configurations such as two people sitting side-by-side or across the table to share a beverage.

Figures 4A, 4B:
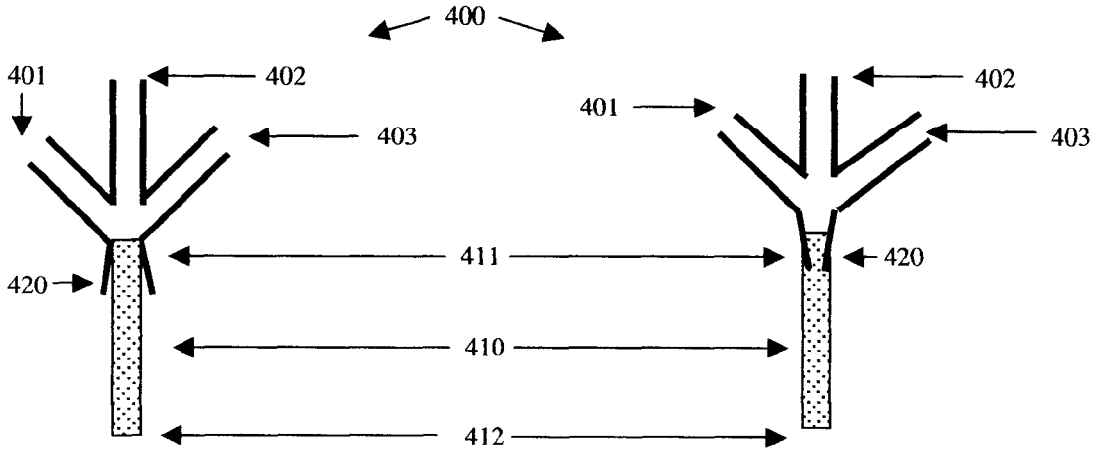
FIG. 4 illustrates a beverage sharing/tasting straw that can be fitted on top of any single-person straw widely available in restaurants, fast food shops and the like, in accordance with yet another embodiment of the present invention.
Figure 5:
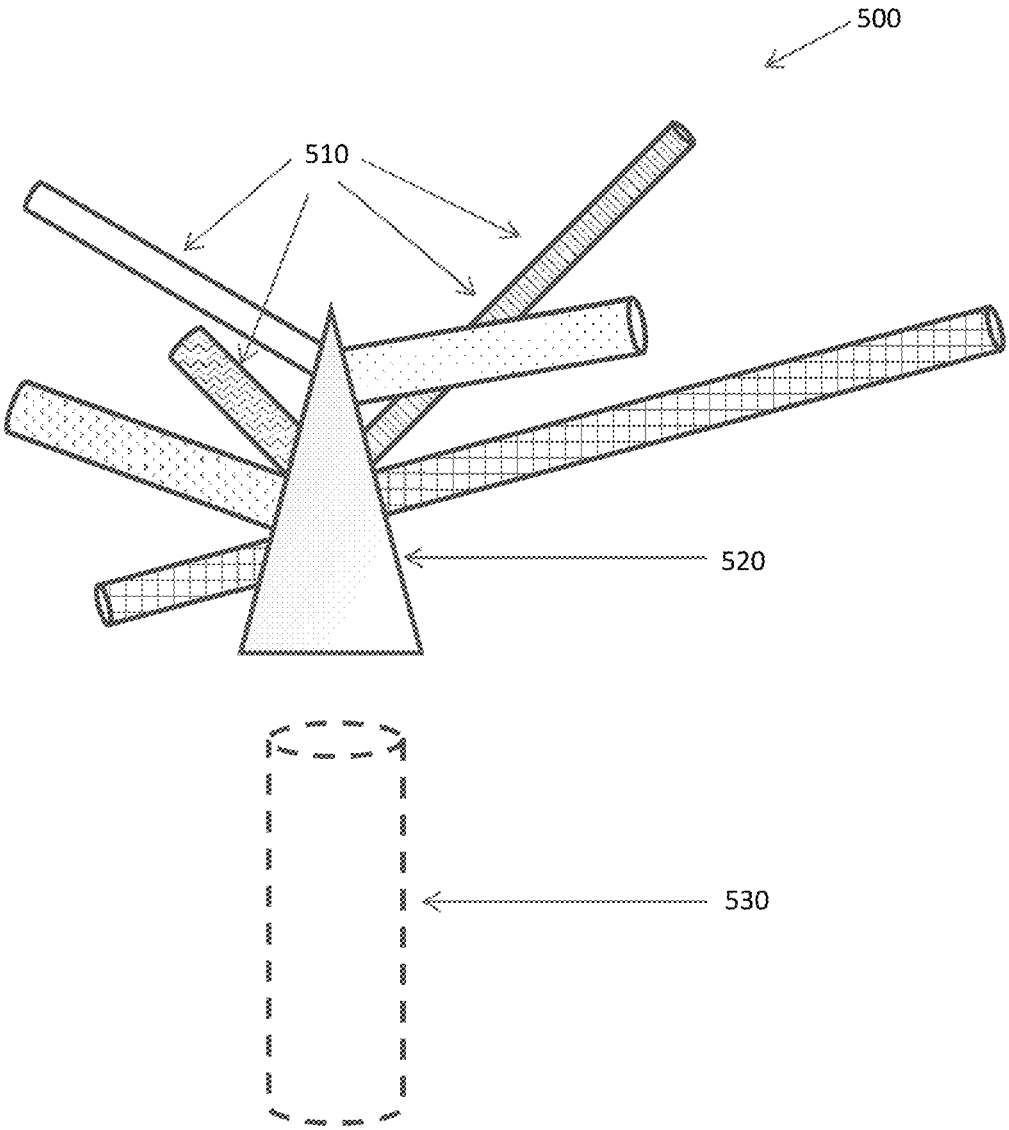
FIG. 5 illustrates a beverage sharing/tasting straw attachment 500 that can be fitted on top of any single-person straw 530 widely available in restaurants, fast food shops and the like, in accordance with yet another embodiment of the invention. The beverage sharing/tasting straw attachment 520 consists of multiple suction ends 510 with different lengths/dimensions of suction ends to adapt to kids/adults and to distinguish them so each person can choose a particular character suction end and drink from the same beverage cup/container without risk of transmitting viruses.
Figure 6A:
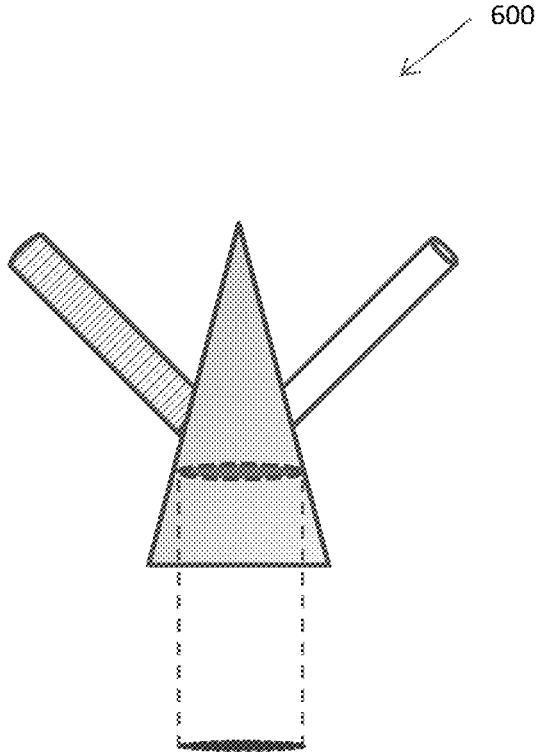
FIG. 6*a* illustrates a beverage sharing/tasting straw attachment 600 for two people sitting across the table and FIG. 6*b* illustrates a beverage sharing/tasting straw attachment 600 side by side in accordance with yet another embodiment of the present invention.
Figure 6B:
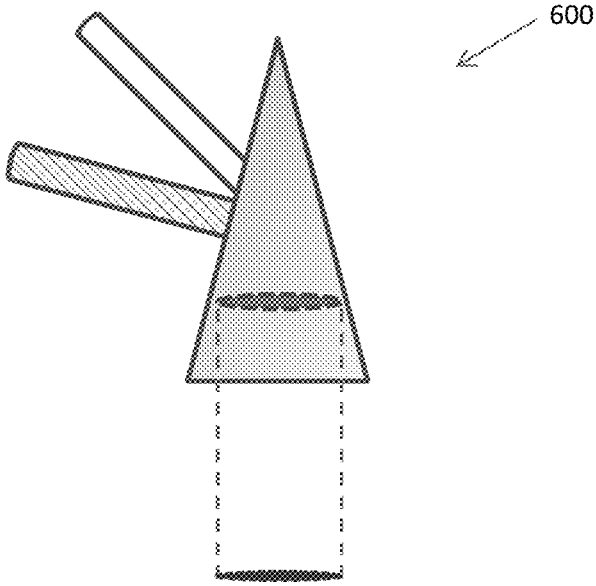

FIG. 4*a* and FIG. 4*b* illustrates a beverage sharing/tasting straw attachment 400 which can be fitted on top of any single-person straw 410 widely available in restaurants, fast food shops and the like, in accordance with another embodiment of the present invention. The single-person straw 410 consists of a suction end 411 and a dipping end 412 that is placed inside the beverage cup/container. The beverage sharing/tasting straw attachment 400 consists of three independent suction heads 401, 402, and 403 and to enable three different people to drink from the same beverage cup/container without risk of transmitting viruses. The beverage sharing/tasting straw attachment 400 also consists of a customized dipping end 420 that fits on top of the suction end 411 of single-person straw 410. The customized dipping end 420 is shaped either as an expanding cone as shown in FIG. 4*a* or as a contracting cone as shown in FIG. 4*b* to adapt to the different diameters in the suction end of single-person straw 410 widely available in restaurants, fast food shops and the like. The diameters of these cones could be varied from slightly smaller than the diameter of widely-available single-person straws at one end to larger than the diameter of widely-available single-person straws at the other end to ensure the attachment fits.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A multi-person beverage sharing/tasting reusable straw attachment design comprising:

plurality of suction ends;

one dipping end that sits on top of any widely-available single-person straw;

wherein the dipping end is shaped as an expanding cone comprising:

a narrower end where the diameter of the cone is smaller than the diameter of any widely-available single-person straws;

a broader end where the diameter of the cone is greater than the diameter of any widely-available single-person straws;

wherein the diameter of these cones is variable, thereby when the attachment is lowered on to widely-available single-person straw, the top of the straw is flush with the cone between the narrow and broad ends;

thereby allowing different configurations suction ends attach on top of the dipping end to allow for specific seating configuration such as side by side seating vs. seating across the table;

wherein the suction end dimensions are different, thereby allowing different diameters of suction ends;

wherein the suction ends are of different lengths, thereby allowing customization for people of different ages;

wherein the suction ends and dipping end are made out of stainless steel, copper silver or gold, thereby allowing re-use and customization;

wherein the combination of height, length, dimensions of suction ends and materials can be varied, thereby allowing mass production for common family size and seating requirements including smaller suction ends adjacent to each other on the cone for kids sitting side by side and longer suction ends on the other side of the cone for parents sitting across the table;

wherein each of the suction ends is uniquely differentiable based on a combination of color, logo, sleeve, initials, and material;

thereby, enabling multiple people of different ages, sitting together in a variety of seating arrangements, to share the same beverage simultaneously from the same cup or container, using their differentiated suction ends.

* * * * *